US006978892B2

(12) United States Patent
Bansal et al.

(10) Patent No.: US 6,978,892 B2
(45) Date of Patent: Dec. 27, 2005

(54) PRODUCT TRAY

(75) Inventors: Vinod Kumar Bansal, Edison, NJ (US); Stephen Anthony Gaeta, Flemington, NJ (US)

(73) Assignee: Unilever Bestfoods, North America, division of Conopco, Inc., Englewood Cliffs, NJ (US)

( * ) Notice: Subject to any disclaimer, the term of this patent is extended or adjusted under 35 U.S.C. 154(b) by 158 days.

(21) Appl. No.: 10/401,981

(22) Filed: Mar. 28, 2003

(65) Prior Publication Data

US 2004/0188305 A1 Sep. 30, 2004

(51) Int. Cl.[7] ..... B65D 71/08
(52) U.S. Cl. ..... 206/497; 206/427
(58) Field of Search ..... 206/427, 429, 206/431, 432, 497; 229/164

(56) References Cited

U.S. PATENT DOCUMENTS

| | | | | |
|---|---|---|---|---|
| 1,422,529 A | | 7/1922 | Bingaman | |
| 2,690,285 A | * | 9/1954 | Main | 229/164 |
| 3,027,064 A | * | 3/1962 | Thomas | 229/164 |
| 3,473,654 A | * | 10/1969 | Zimmerman | 206/427 |
| 3,901,383 A | | 8/1975 | Witt | |
| 4,475,653 A | * | 10/1984 | Ullman | 206/497 |
| 4,753,341 A | * | 6/1988 | McIntyre | 229/164 |
| 5,364,020 A | | 11/1994 | Bansal | |
| 5,577,612 A | | 11/1996 | Chesson et al. | |
| 5,918,801 A | | 7/1999 | Milio | |
| 6,293,405 B1 | * | 9/2001 | Burch, Jr. | 206/427 |
| 6,435,403 B1 | | 8/2002 | Giblin et al. | |
| 6,755,306 B2 | * | 6/2004 | Maus | 229/164 |

FOREIGN PATENT DOCUMENTS

| | | |
|---|---|---|
| BE | 905 803 | 3/1987 |
| DE | 77 19 260 | 11/1977 |
| DE | 80 08 233 U | 7/1980 |
| DE | 40 19 994 A1 | 1/1992 |
| FR | 1 348 088 | 1/1964 |
| FR | 2 827 260 | 1/2003 |
| GB | 164 268 A | 6/1921 |
| WO | 01/87721 | 11/2001 |

OTHER PUBLICATIONS

Partial International Search Report on PCT/EP 2004/002030 dated Jul. 7, 2004.
International Search Report on PCT/EP 2004/002030.

* cited by examiner

*Primary Examiner*—Luan K. Bui
(74) *Attorney, Agent, or Firm*—Edward A. Squillante, Jr.

(57) ABSTRACT

A product tray having a back panel that is higher than the front and side panels is described. The product tray surprisingly has excellent compressive strength when filled with product and allows for good product visibility from the front and side without comprising the stability of the product within the tray.

15 Claims, 9 Drawing Sheets

PRODUCT TRAY

FIELD OF THE INVENTION

The present invention is directed to a product tray. More particularly, the invention is directed to a product tray having a back panel that is higher than the front and side panels. The product tray surprisingly has excellent compressive strength when filled with product, notwithstanding the fact that it uses less material (e.g., paperboard) than conventional product boxes. Moreover, the product tray of this invention allows for good product visibility from the front and side without compromising the stability of the product within the tray.

BACKGROUND OF THE INVENTION

Many consumer products are displayed and sold in the conventional boxes or trays they are shipped in. Displaying and selling products in the boxes or trays they are shipped in are desirable because products do not have to be unpacked and individually placed on shelves prior to selling. Moreover, many club-stores do not bag products for consumers, and selling products in the boxes or trays they are shipped in makes handling of the products significantly easier for consumers.

While conventional boxes or trays have some desirable characteristics, they also have many drawbacks. For example, many conventional trays have front and side panels that are about 25% of the height of the products that are packed in them. While such conventional trays do allow for product visibility and paperboard conservation, they typically are incapable of supporting products in the upright position and do not offer any strength from a compression standpoint.

Conventional boxes, on the otherhand, have front and side panels that cover the products that are packed in them. These conventional boxes may support the compressive load imposed during shipping and warehousing; however, they utilize significant amounts of paperboard and make visibility of the products packed therein very difficult, especially from the front and sides.

It is of increasing interest to develop a product tray that can support products in an upright position, offer strength from a compression standpoint, and that allows for product visibility without using excessive amounts of material. This invention, therefore, is directed to a product tray having a back panel that is higher than the front and side panels. The product tray has excellent compressive strength when filled with product, notwithstanding the fact that it uses less material than conventional product boxes.

Additional Information

Efforts have been disclosed for making cartons. In U.S. Pat. No. 6,435,403, a display carton suitable for heavy consumer products is disclosed.

Other efforts have been disclosed for making cartons. In U.S. Pat. No. 5,918,801, a shipping case with advertising matter is described.

Still other efforts have been disclosed for making cartons. In U.S. Pat. No. 5,577,612, fabric softener sheet dispenser cartons are disclosed.

None of the additional information above describes a product tray that offers excellent compressive strength and product stability, while at the same time offering good product visibility from the front and sides.

SUMMARY OF THE INVENTION

The present invention is directed to a product tray comprising, when unfolded:

(a) a flat surface comprising a front and back edge, a left and right side edge and a first and second parallel hinge, both the first and second parallel hinge run parallel to the front and back edges and to each other, the first parallel hinge being a distance (d1) from the front edge and the second parallel hinge being a distance (d2) from the back edge;

(b) a first and second perpendicular hinge running perpendicular to the front and back edge and first and second parallel hinge and parallel to the left and right edges, the first perpendicular hinge being a distance (d3) from the left side edges and the second perpendicular hinge being a distance (d4) from the right side edges;

(c) points of intersection where the first perpendicular hinge intersects the first and second parallel hinge, and where the second perpendicular hinge intersects the first and second parallel hinge wherein d2>d1, and d3 and d4<d2 and a distinct slot converging towards each point of intersection and diverging towards the side edges so that the first and second parallel hinge have, as end points, a point of intersection, and product packed in the product tray, when folded, has a product height H that is substantially the same as product tray height h.

In a second aspect, the present invention is directed to the product tray of the first aspect in folded form and packed with product.

Material, as used herein, means any substance suitable to make a product box for packaging consumer products. Illustrative examples of such material are plastic, paperboard, (both corrugated and non-corrugated) as well as light-weight wood and a mixture thereof. Substantially perpendicular as used herein means greater than 45 degrees and less than 90 degrees; and preferably, from about 70 degrees to about 89 degrees. Rest or resting on is defined to mean making at least some contact.

BRIEF DESCRIPTION OF THE FIGURES

The subject matter which is regarded as the invention is particularly pointed out and distinctly claimed in the concluding portion of the specification. The invention, however, may be best understood by reference to the following description taken in conjunction with the accompanying drawing figures in which:

DETAILED DESCRIPTION OF THE PREFERRED EMBODIMENTS

The only limitation with respect to the material used to make the product tray of this invention is that the material is suitable for use in packaging associated with consumer products. Illustrative examples of the material that may be used to make the product tray of this invention is plastic, corrugated and solid fiber paperboard as well as light weight wood. The material used to make the product tray may be new, recycled or a mixture thereof. In a preferred embodiment, the product tray of this invention comprises at least about 50.0% by weight recycled material. In a most preferred embodiment, the product tray of this invention comprises at least about 50.0% by weight recycled material and is corrugated paperboard.

Figure 1:
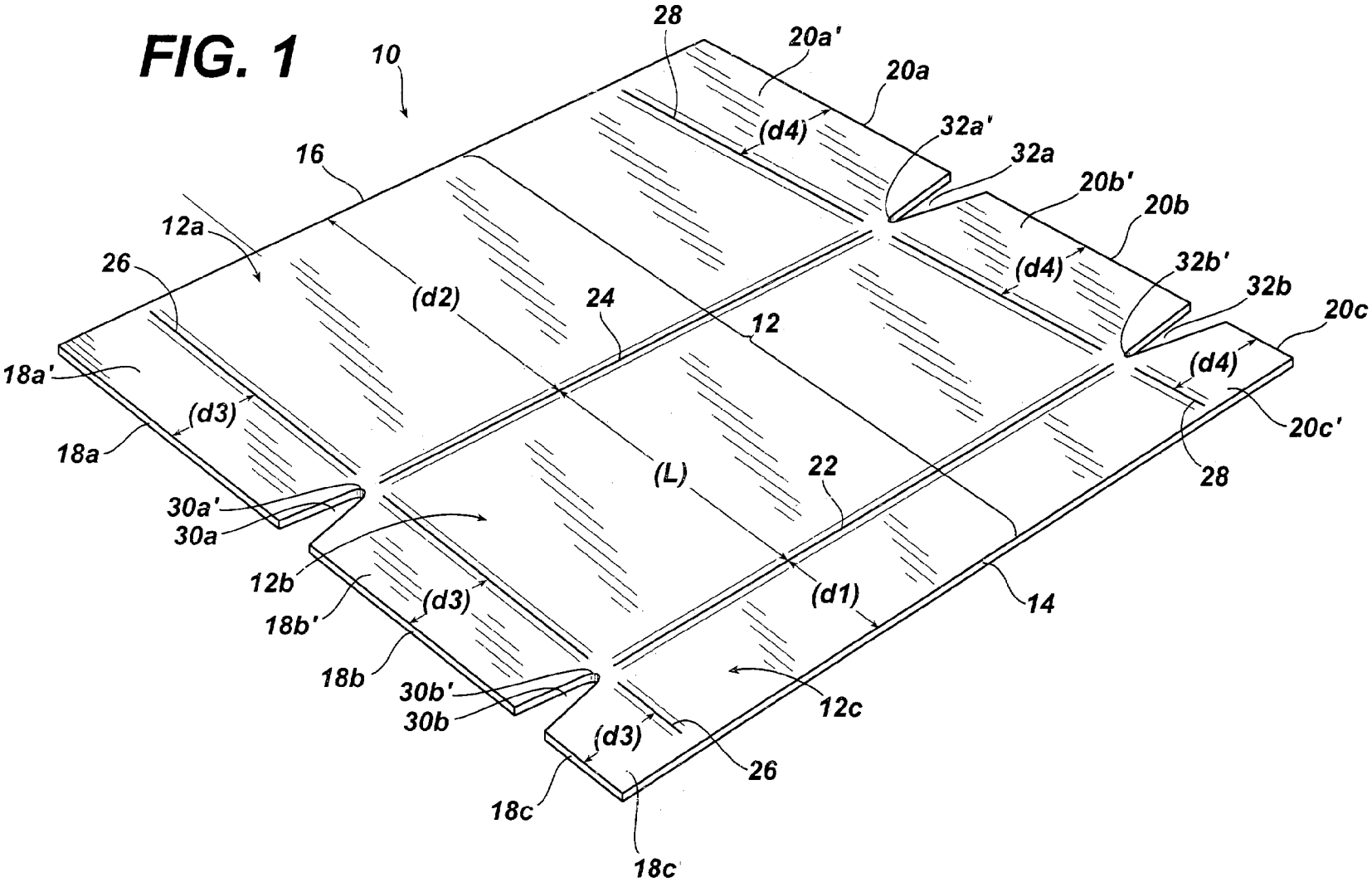
FIG. 1 depicts a perspective view of the product tray of this invention in unfolded form.

Turning to FIG. 1, shown is an unfolded product tray 10 comprising a flat surface 12 having back, middle and front flat surfaces 12*a,* 12*b* and 12*c,* respectively, a front edge 14, a back edge 16, back, middle and front left side edges 18*a,* 18*b* and 18*c,* respectively, back, middle and front right side edges 20*a,* 20*b* and 20*c,* respectively, and a first and second parallel hinge 22 and 24, respectively, which can be, for example, perforations, bends or scores in the flat surface 12. The first parallel hinge 22 and second parallel hinge 24 run parallel to the front and back edges, 14 and 16, respectively, and to each other, whereby the first parallel hinge 22 is a distance (d1) from the front edge 14 and the second parallel hinge is a distance (d2) from the back edge 16.

The unfolded product tray 10 further comprises first and second perpendicular hinges, 26 and 28, respectively, which can be, for example, perforations, bends or scores in the flat surface 12 and that run perpendicular to the front and back edges, 14 and 16, respectively, and first and second parallel hinges 22 and 24, respectively, and parallel to left edges 18*a–c* and right edges 20*a–c.* The first perpendicular hinge 26 is a distance (d3) from left side edges 18*a–c* and the second perpendicular hinge 28 is a distance (d4) from right side edges 20*a–c.* First and second left slot, 30*a* and 30*b*, respectively, converge towards first and second left points of intersection 30*a′* and 30*b′,* respectively, and first and second right slots 32*a* and 32*b,* respectively, converge towards first and second left and right points of intersection 32*a′* and 32*b′,* respectively, wherein first left slot 30*a* forms a void between back left side edge 18*a* and middle left side edge 18*b* and back left panel 18*a′* and middle left panel 18*b′* and second left slot 30*b* forms a void between middle left side edge 18*b* and front left side edge 18*c* and middle left panel 18*b′* and front left panel 18*c′.* Middle surface 12*b* is a length (L) that can vary, but preferably is less than (d2) and greater than (d1), thereby providing adequate advertising space on back flat surface 12*a.* Distance (d2) is greater than distance (d1) and distance (d3) and distance (d4) are preferably equal, and greater than or equal to distance (d1). In a preferred embodiment, distance (d2) is about 5.0 to about 50.0% greater than length (L), and distance (d2) is about 2.0 to about 4.0 times greater than distances (d1), (d3) and (d4).

First right slot 32*a* forms a void between back right side edge 20*a* and middle right side edge 20*b* and back right panel 20*a′* and middle right panel 20*b′* and second right slot 32*b* forms a void between middle right side edge 20*b* and front right side edge 20*c* and middle right panel 20*b′* and front right panel 20*c′.*

Figure 2:
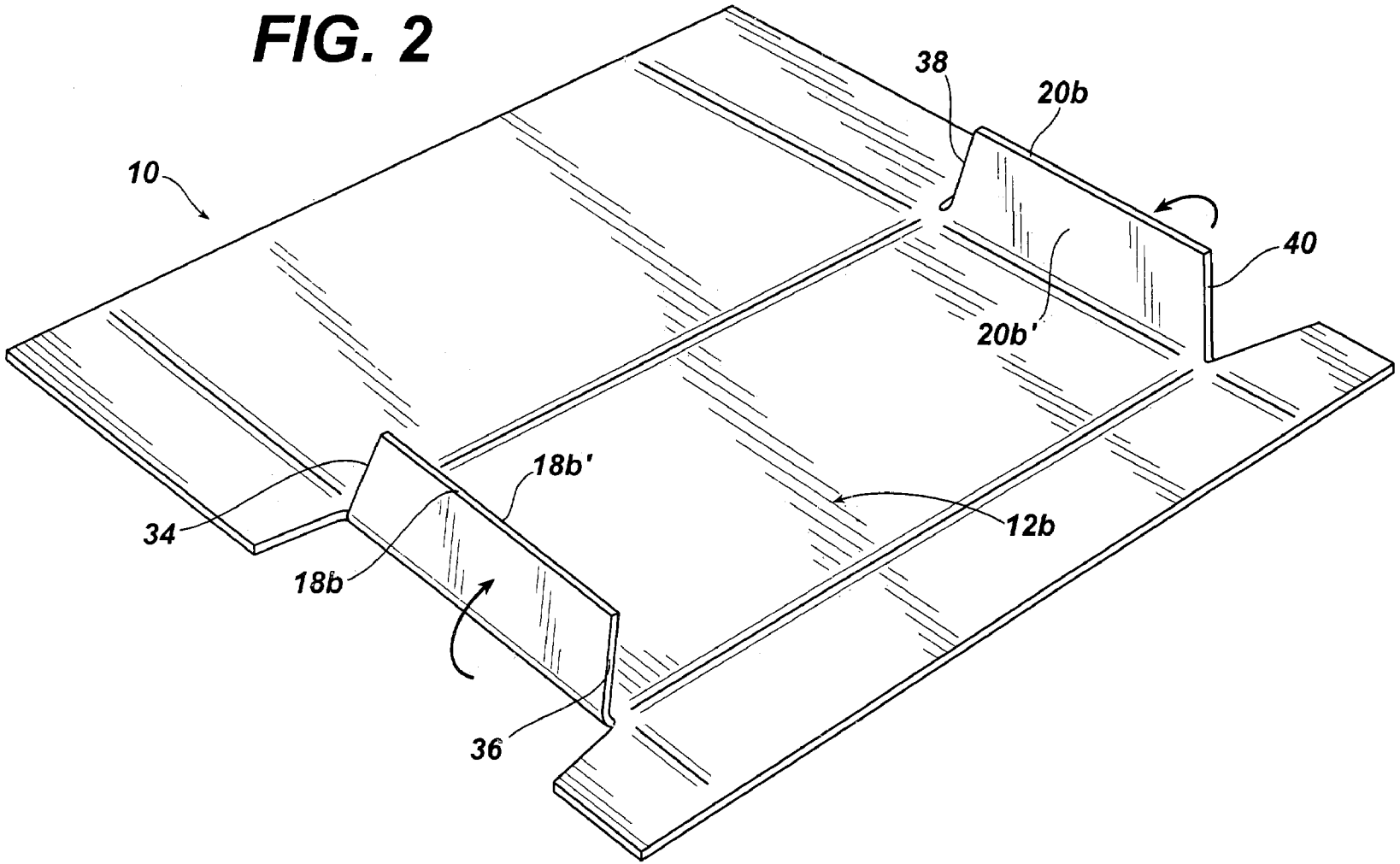
FIG. 2 depicts the product tray of this invention with sides folded upright.

Turning to FIG. 2, shown is product tray 10 with middle left panel 18*b′* and middle right panel 20*b′* folded or pivoted (clockwise and counter clockwise, respectively) preferably perpendicular to middle flat surface 12*b* via first and second perpendicular hinges 26 and 28, respectively, wherein middle left panel 18*b′* and middle right panel 20*b′* are the sides of the product tray 10 when folded or pivoted perpendicular to flat surface 12*b,* exposing middle left side edge 18*b* and middle right side edge 20*b* from the top as well as left back and front flap walls 34 and 36 (respectively) and right back and front flap walls 38 and 40 (respectively).

Figure 3:
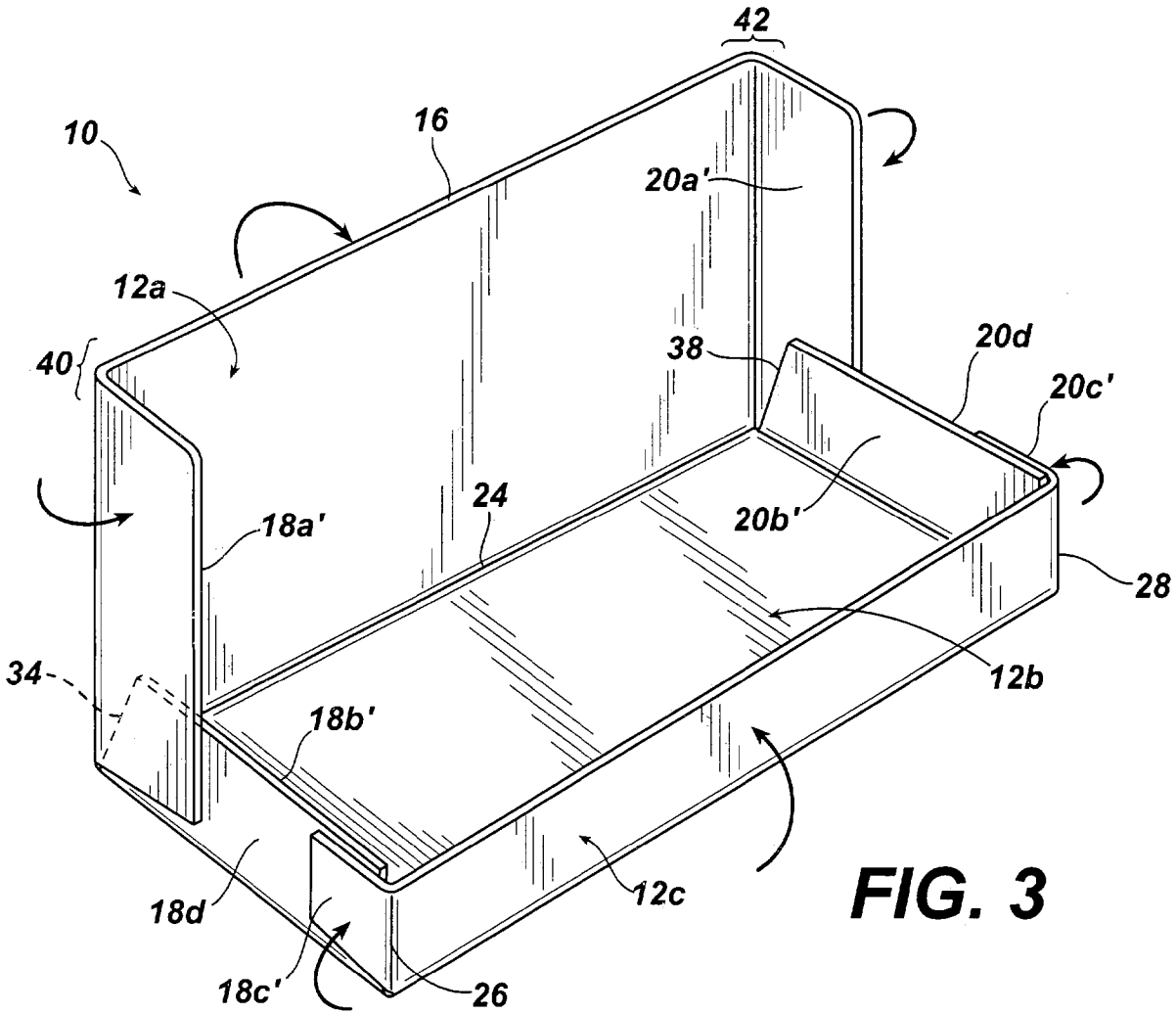
FIG. 3 depicts the product tray of this invention folded with sides folded and supported by front and rear flaps.

FIG. 3 shows front flat surface 12*c* folded or pivoted upward via first parallel hinge 22 and substantially perpendicular to middle flat surface 12*b* so that front flat surface 12*c* preferably rests on left front flap wall 36 and right front flap wall 40. Front left panel 18*c′* and front right panel 20*c′* may be folded inward by pivoting the same on first perpendicular hinge 26 and second perpendicular hinge 28, respectively, ensuring that front left panel 18*c′* contacts left exterior side wall 18*d* and that front right panel 20*c′* contacts right exterior side wall 20*d* when front panel 18*c′* contacts left exterior side wall 18*d* and front right panel 20*c′* contacts right exterior side wall 20*d.* Fastening means, like glue, staples or tape, may be used to secure all points of contact.

Back flat surface 12*a* may be pivoted or folded upward via second parallel hinge 24 so that back flat surface 12*a* is substantially perpendicular to middle flat surface 12*b,* and preferably, resting on left back flap wall 34 and right back flap wall 38. Back left panel 18*a′* and back right panel 20*a′* may be folded inward by pivoting the same on first perpendicular hinge 26 and second perpendicular hinge 28, respectively, ensuring that back left panel 18*a′* contacts left exterior side wall 18*d* and that back right panel 20*a′* contacts right exterior side wall 20*d.* When back left panel 18*a′* contacts left exterior side wall 18*d* and back right panel 20*a′* contacts right exterior side wall 20*d,* fastening means, as defined above, may be used to secure all points of contact.

Subsequent to folding product tray 10, as shown in FIG. 3, left upper corner support 40 and right upper corner support 42 are formed to significantly enhance the strength of the product tray from a compression or stacking standpoint whereby back edge 16 and the combination of back left panel 18*a′,* back flat surface 12*a,* and back right panel 20*a′* take on a C-shape to assist in stabilizing product (not shown), especially in the upright position.

Figure 4:
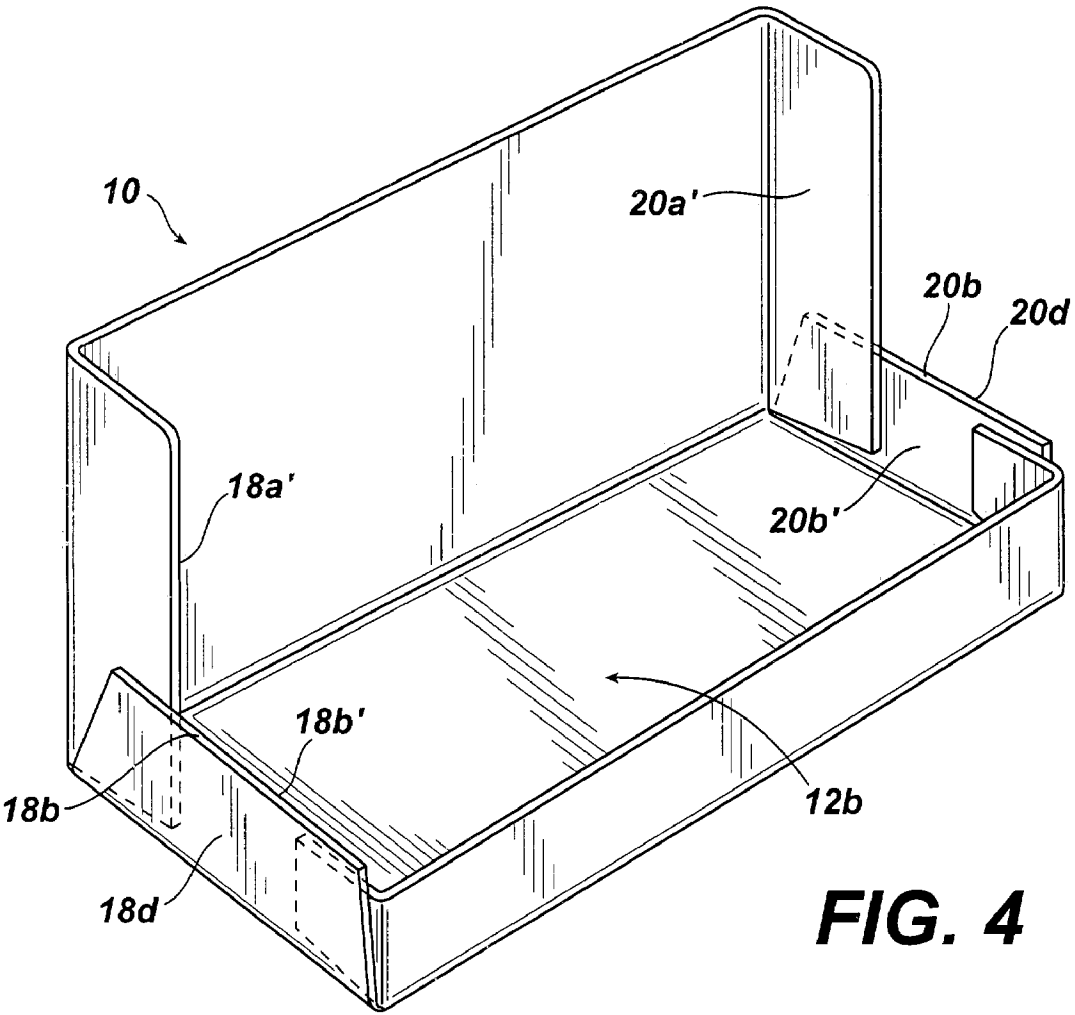
FIG. 4 depicts the product tray of this invention with sides folded and supporting front and rear flaps.

FIG. 4 shows product tray 10 of the present invention in folded form with, however, middle left panel 18*b′* and middle right panel 20*b′* folded or pivoted upward and supporting, (from the exterior) back left panel 18*a′* and back right panel 20*a′* and front, left panel 18*c′* and front right panel 20*c′* in lieu of the reverse as shown in FIG. 3. In an especially preferred embodiment, middle left side edge 18*b* and middle right side edge 20*b* are parallel to each other, horizontal and not extending upward to the top of the back of the product tray 10 in folded form to ensure excellent visability from the sides.

Figure 5:
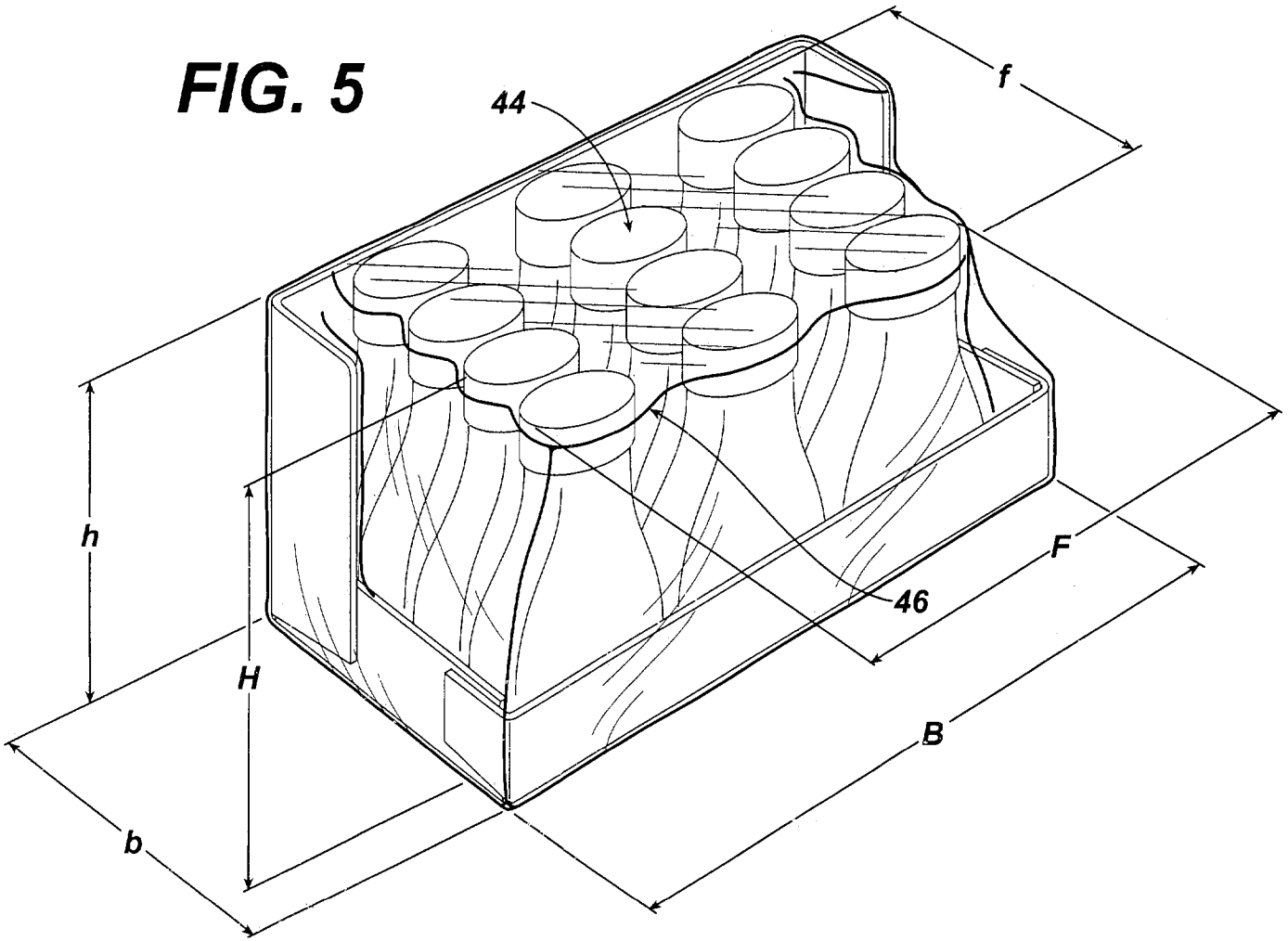
FIG. 5 depicts the product tray of this invention with product packed and shrink-wrapped therein.

FIG. 5 shows the product tray 10 of this invention with product 44 packed therein and in an upright position. In a preferred embodiment of this invention, the height of the product H and the product box height h are substantially the same (i.e., within 3.0% of each other), and preferably, the same height. In another preferred embodiment, product tray 10 packed with product 44 is not covered with a material suitable to make a product tray (i.e. a product tray top) but is covered with a transparent or translucent shrink-wrap film 46 made of a polymeric material like polyethylene, polypropylene, polyolefin or a copolymer thereof. When covered with shrink wrap, product 44 is fully supported in product tray 10, and particularly, in the upright position. In an especially preferred embodiment, product 44 packed in product tray 10 has a footprint area, defined as Fxf, that is from about 20 to about 50 percent smaller than the tray base area, defined as Bxb.

Figure 6:
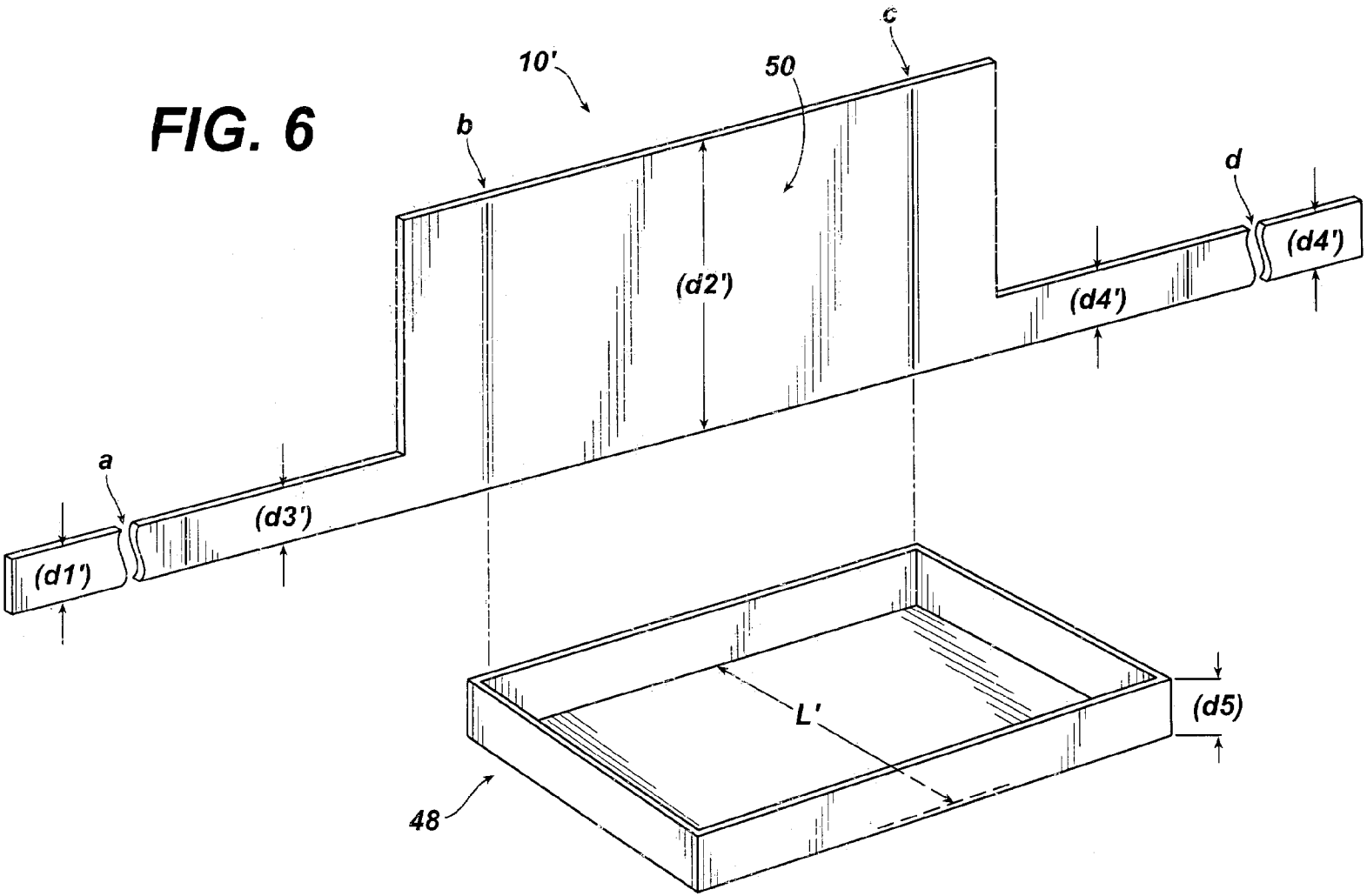
FIG. 6 depicts the product tray of the present invention unassembled and in two piece form.

FIG. 6 shows unassembled product tray 10' having a base plate 48 and a four (4) hinged (a, b, c, d) foldable side panel 50.

Figure 7:
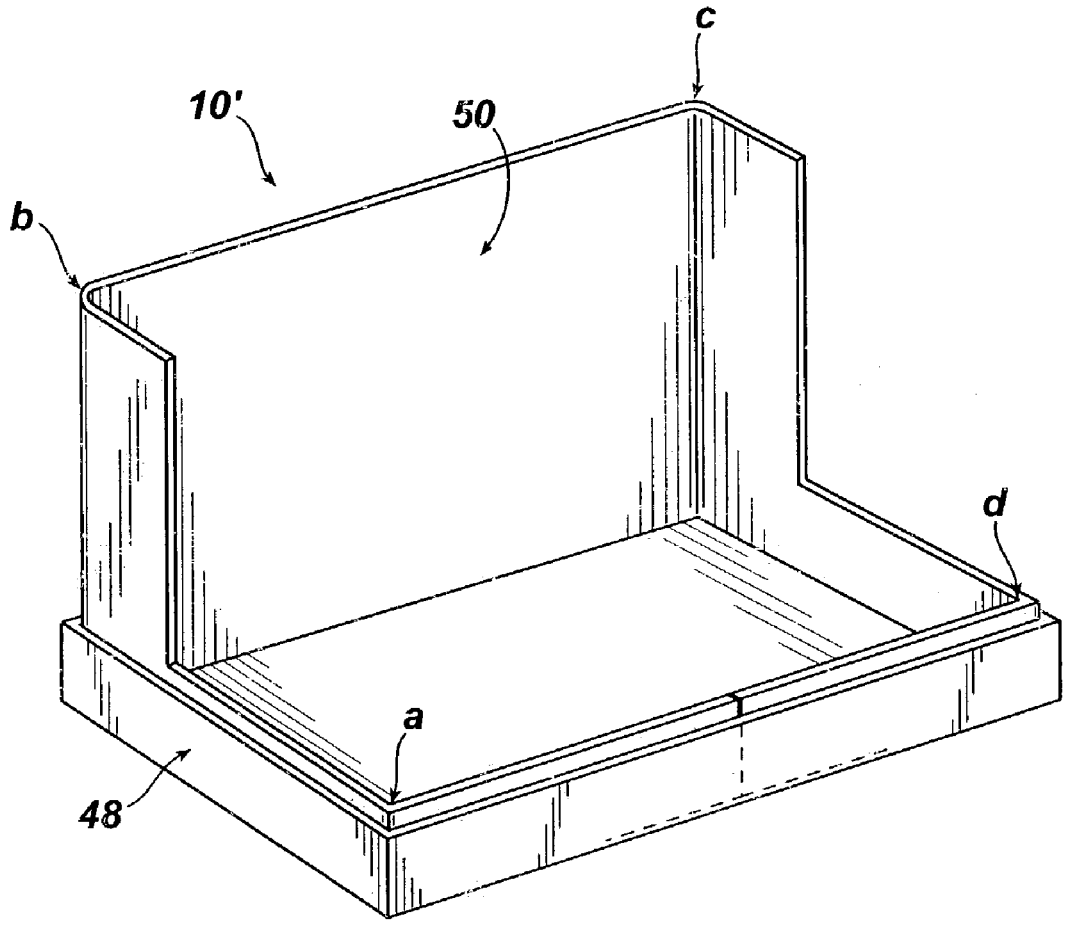
FIG. 7 depicts the product tray of this invention assembled in two piece form.

FIG. 7 shows side panel 50 with each hinge rotated 90 degrees inward so that foldable side panel 50 may be folded for insertion into base plate 48 to form assembled product tray 10'. FIGS. 6 and 7, therefore, demonstrate that the product tray of the present invention may be one piece or two pieces when unfolded or unassembled. The relationship between distances (d1'), (d2'), (d3'), (d4'), and (L') (as shown in FIG. 6) is identical to the relationship between distances (d1), (d2), (d3), (d4), and L. Distance (d5), however, is often about equal to distance (d1') and distance (d4'), and most preferably, about 5.0 to about 15.0% larger or smaller than distance (d1') and distance (d4').

Figure 8:
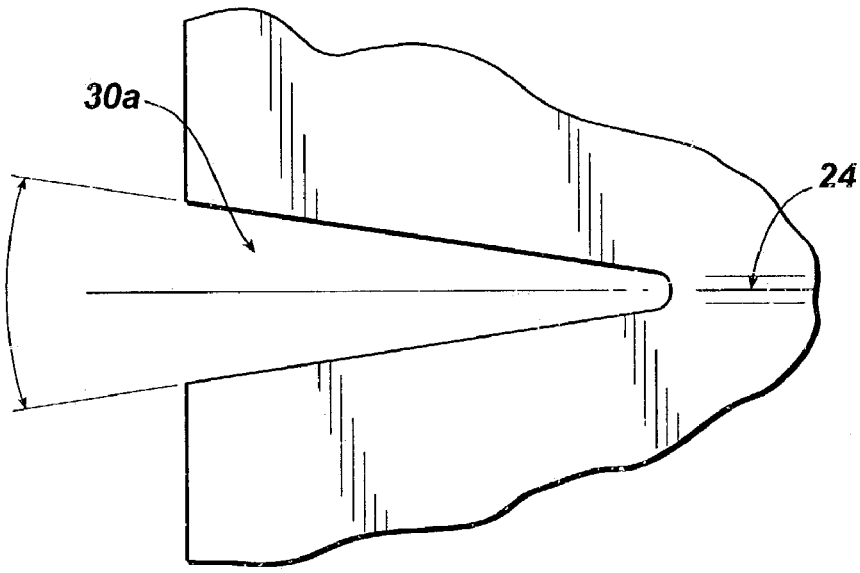
FIGS. 8 and 9 show two preferred slots for use in the product tray.
Figure 9:
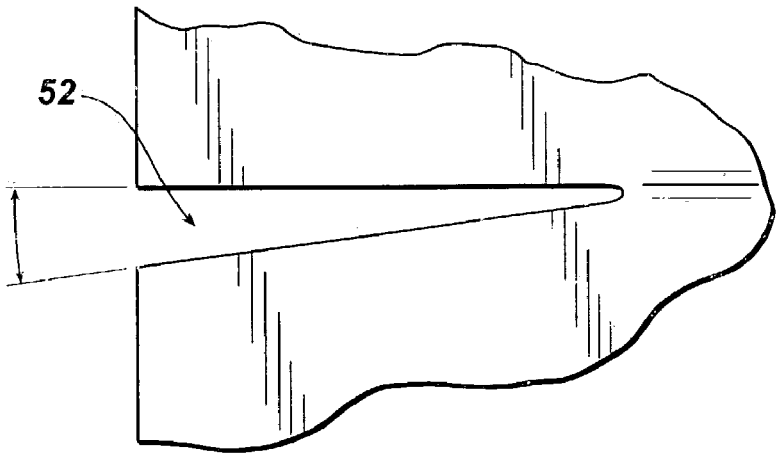
Figure 10:
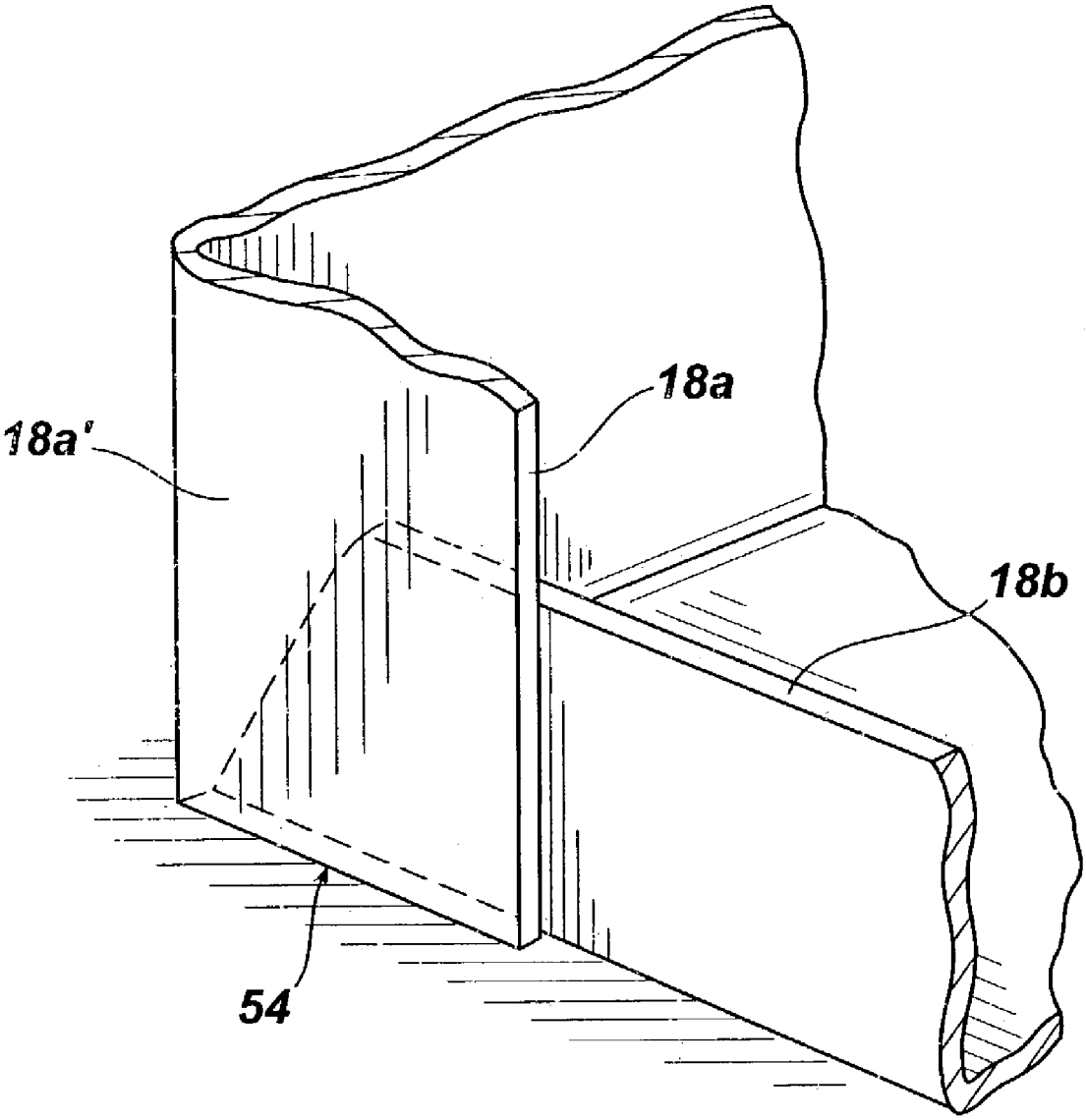
FIG. 10 shows the product tray having a back panel folded and perpendicular to the side.

Turning to FIG. 8, shown is slot 30*a* and a portion of second parallel hinge 24. Slot 30*a* is generally, and often, shaped like an isosceles triangle. It is within the scope of this invention, however, for all slots made within product tray 10 to be shaped like right angles as shown by slot 52 of FIG. 9. It is noted that when all slots are shaped like right angles, front surface 12*c* and back flat surface 12*a* will be perpendicular to middle flat surface 12*b* and standing parallel to each other. FIG. 10 shows back left panel 18*a'* resting on its back left footing edge 54, whereby back left side edge 18*a* is perpendicular to middle left side edge 18*b*, resulting from a right triangular slot, not shown, being present in lieu of a slot that is isosceles triangle like.

It should be understood that the specific forms of the invention herein illustrated and described are intended to be representative only and certain changes may be made therein without departing from the clear teachings of the disclosure. Accordingly, reference should be made to the following appended claims in determining the full scope of the invention. It should also be understood that the product packed in the product tray of this invention can be, for example, any consumer product suitable for filling in a box, can or bottle, like a box of detergent or a bottle of salad dressing.

EXAMPLE

Three sets of pallets (about 40×48 inches) were assembled as follows:

Set one had three pallets that were stacked with Unilever Bestfoods' Wishbone Salad Dressing bottles (16 oz.) packed (and wrapped with polyethylene) in the product tray of this invention and as depicted in FIG. 5. Each pallet was stacked 5 product trays high (each layer separated by a slip sheet) and the three pallets were stacked on each other, also separated by a slip sheet.

Set two was similar to set one except that conventional boxes with all four sides at the height of the bottles were used in lieu of the product tray of this invention and there were no slip sheets used between the layers of boxes.

Set three was similar to set one except that conventional trays with all four sides at about 25% of the height of the bottles were used in lieu of the product tray of this invention.

The three sets of pallets were shipped, and stacked for about a two week period. Visual observations, after shipping and stacking, unexpectedly revealed that the product trays of this invention performed as well as the conventional boxes of set two and significantly better than the conventional trays of set three, which fell over and/or were unable to maintain all product in the upright position. The results indicate that the product tray of this invention allows for efficient shipping and stacking of product and excellent visibility from three sides, even when the footprint area is from about 20 to about 50% smaller than the tray base area.

What is claimed:

1. A product tray comprising, when unfolded:

(a) a flat surface comprising a front and back edge, a left and right side edge and a first and second parallel hinge, both the first and second parallel hinge run parallel to the front and back edges and to each other, the first parallel hinge being a distance (d1) from the front edge and the second parallel hinge being a distance (d2) from the back edge;

(b) a first and second perpendicular hinge running perpendicular to the front and back edge and first and second parallel hinge and parallel to the left and right edges, the first perpendicular hinge being a distance (d3) from the left side edges and the second perpendicular hinge being a distance (d4) from the right side edges;

(c) points of intersection where the first perpendicular hinge intersects the first and second parallel hinge, and where the second perpendicular hinge intersects the first and second parallel hinge wherein d2>d1, and d3 and d4<d2 and a distinct slot converging towards each point of intersection and diverging towards the side edges so that the first and second parallel hinge have, as end points, a point of intersection, and product packed in the product tray, when folded, has a product height H that is substantially the same as product tray height h and is shrink-wrapped and not covered by paperboard.

2. The product tray according to claim 1 wherein the slots are shaped like an isosceles triangle.

3. The product tray according to claim 1 wherein the slots are shaped like a right triangle.

4. The product tray according to claim 1 wherein the product tray is made of material which is plastic, paperboard, wood or a mixture thereof.

5. The product tray according to claim 4 wherein at least about 50.0% of the material is recycled material.

6. A product tray comprising:

(a) a flat surface comprising a front and back edge, a left and right side edge and a first and second parallel hinge, both the first and second parallel hinge run parallel to the front and back edges and to each other, the first parallel hinge being a distance (d1) from the front edge and the second parallel hinge being a distance (d2) from the back edge;

(b) a first and second perpendicular hinge running perpendicular to the front and back edge and first and second parallel hinge and parallel to the left and right edges, the first perpendicular hinge being a distance (d3) from the left side edges and the second perpendicular hinge being a distance (d4) from the right side edges;

(c) points of intersection where the first perpendicular hinge intersects the first and second parallel hinge, and where the second perpendicular hinge intersects the first and second parallel hinge where (i) d2>d1, and d3 and d4<d2, (ii) a distinct slot converges towards each point of intersection and diverges towards the side edges so that the first and second parallel hinge have, as end points, a point of intersection; (iii)

product packed in the product tray has a product height H that is substantially the same as product tray height h; (iv) the flat surface has back, middle and front flat surfaces and back, middle and front left side panels and back, middle and front right side panels, wherein middle left panel and middle right panel are folded upward and substantially perpendicular to middle flat surface to make product tray sides and the front flat surface and back flat surface are folded upward and substantially perpendicular to the middle flat surface to make front and back product tray panels and further wherein the product tray with product therein is covered with shrink-wrap.

7. The product tray according to claim 6 wherein the back and front left side panels are folded inward to contact the middle left panel, and the back and front right side panels are folded inward to contact the middle right panel.

8. The product tray according to claim 7 wherein middle left panel is exterior to the back and front left side panels and the middle right panel is exterior to the back and front right side panels.

9. The product tray according to claim 7 wherein middle left panel is interior to the back and front left side panels and the middle right panel is interior to the back and front right side panels.

10. The product tray according to claim 6 wherein the product height H and the product tray height h are the same.

11. The product tray according to claim 6 wherein the product tray has a base that is 20 to 50 percent larger than a footprint area created by the product.

12. A product tray comprising a floor, left and right side walls and a front wall, the left and right side walls and front wall being substantially the same size wherein the product tray has a back wall that is about 5.0 to about 50.0% larger than the floor and a height that is 2.0 to 4.0 times higher than the front and side walls, the product tray being packed with product having a height that is substantially equal to the height of the back wall wherein the product tray with product packed therein is shrink-wrapped.

13. The product tray of claim 12, wherein when disassembled, the product tray is one piece.

14. The product tray of claim 12, wherein when disassembled, the product tray is two pieces.

15. The product tray of claim 12 wherein the product tray has a base that is 20 to 50 percent larger than a foot print area created by the product.

* * * * *